US010016692B2

(12) United States Patent
Zamperla

(10) Patent No.: US 10,016,692 B2
(45) Date of Patent: Jul. 10, 2018

(54) WATER AMUSEMENT RIDE

(71) Applicant: ANTONIO ZAMPERLA S.P.A., Altavilla Vicentina (IT)

(72) Inventor: Alberto Zamperla, Altavilla Vicentina (IT)

(73) Assignee: ANTONIO ZAMPERLA S.P.A., Altavilla Vicentina (IT)

( * ) Notice: Subject to any disclaimer, the term of this patent is extended or adjusted under 35 U.S.C. 154(b) by 0 days.

(21) Appl. No.: 15/526,372

(22) PCT Filed: Nov. 17, 2014

(86) PCT No.: PCT/EP2014/074810
§ 371 (c)(1),
(2) Date: May 12, 2017

(87) PCT Pub. No.: WO2016/078694
PCT Pub. Date: May 26, 2016

(65) Prior Publication Data
US 2017/0333800 A1 Nov. 23, 2017

(51) Int. Cl.
*A63G 3/02* (2006.01)
*A63G 31/00* (2006.01)

(52) U.S. Cl.
CPC ..... *A63G 31/007* (2013.01); *A63G 2031/002* (2013.01)

(58) Field of Classification Search
CPC ... A63G 3/00; A63G 3/02; A63G 3/06; A63G 31/00; A63G 31/007
USPC ..... 472/2, 117, 128, 129, 131, 67; 104/53, 104/71
See application file for complete search history.

(56) References Cited

U.S. PATENT DOCUMENTS 929,972 A * 8/1909 M'Giehan ..... A63G 3/06 104/71
1,473,914 A * 11/1923 Marmon ..... A63G 3/00 472/13
3,930,450 A * 1/1976 Symons ..... A63G 3/00 104/139
5,197,923 A * 3/1993 Barber ..... A63G 3/00 104/86

(Continued)

FOREIGN PATENT DOCUMENTS

EP 1676609 7/2006

OTHER PUBLICATIONS

International Search Report and written opinion of PCT/EP2014/074810 dated Jul. 23, 2015.

(Continued)

*Primary Examiner* — Kien Nguyen

(57) ABSTRACT

It is disclosed a water amusement ride (1) comprising at least one vehicle (2) comprising means (6) for accommodating at least one passenger, a container (10) for storing water having an opening (10*a*) to define a water surface (S). The vehicle (2) is movable between a raised position (RP) with respect to the water surface (S), and a stop position (SP), in which at least part of the vehicle is submerged in the water. The ride further comprises lifting means (30) to move the vehicle from the stop position to the raised position, and wherein the vehicle (2) moved from the raised position (RP) towards said stop position (SP) is decelerated by the contact with water in said container (10) to reach the stop position (SP).

31 Claims, 5 Drawing Sheets

(56) References Cited

U.S. PATENT DOCUMENTS 5,215,016 A * 6/1993 Futami ..... A63G 3/06
104/247
5,616,083 A * 4/1997 Subbaraman ..... A63G 31/007
366/314

OTHER PUBLICATIONS

International Preliminary Report on Patentability of PCT/EP2014/074810 dated May 23, 2017.

* cited by examiner

WATER AMUSEMENT RIDE

RELATED APPLICATION

This application is the U.S. national phase application of international application number PCT/EP2014/074810, filed 17 Nov. 2014, which designates the US and the contents of which are hereby incorporated by reference as if set forth in their entirety.

FIELD OF THE INVENTION

The present invention relates in general to amusement and theme park rides, and in particular to water amusements ride wherein water interacts with a vehicle and is used for increasing the entertainment experience for both passengers (riders) and spectators.

BACKGROUND OF THE INVENTION

Amusement rides and in particular water amusement rides are very popular and park operators and ride producers are continuously seeking to increase the entertainment experience, fun and enjoyment for both the passengers of the amusement rides and the spectators.

Water rides increase the fun of the passengers and are particularly attractive during the summer period.

There are known in the art water rides wherein one or more vehicles provided with seats, intended to be occupied by passengers are moved along a slide partially arranged inside water so that a splash effect can be generated when the vehicle passes in the slide provided with water.

Similar water rides are known in the art with the name of log flumes, wherein vehicles in the form of hollow logs are moved along a water flume by the water flow.

A descent is usually provided in the water flume with a splashdown into a portion of the water flume.

These rides allow interaction of passengers with water splashed in some portions of the slide along which the vehicles (hollow logs) are moved; they are mainly indicated for kids and families but they are not attractive to adult passengers because of the limited fun and thrill Additionally, these rides necessitate a large area for their installation, in order to provide a sufficient length of the water path (water flume) along which the vehicles are move.

Moreover a large amount of water is necessary to correctly operate these amusement rides.

Therefore, it is an aim of the present invention to provide a water amusement ride able to increase the thrill and in general the entertainment experience provided to the passengers.

Another aim of the present invention is to reduce the area on which the amusement ride is installed. A further aim is to reduce the amount of water used for the ride.

SUMMARY OF THE INVENTION

These and other aims are achieved by the water amusement ride of the invention according to claim 1. Further aspects of the present invention are set out in the dependent claims.

The water amusement ride according to the invention comprises at least one vehicle, comprising means for accommodating at least one passenger, and a container, i.e. a reservoir, for storing water, said container being provided with an opening to define a water surface (i.e. a free water surface) through which water can enter or exit the container.

The vehicle is moveable between a raised position with respect the water surface, and a stop position, in which at least part of the vehicle is submerged in the water.

According to an embodiment, in the raised position, the vehicle is at a distance from the water surface.

According to a possible embodiment, in the raised position the vehicle is outside the water and preferably not contacting it, (e.g. suspended) at a distance from the water surface.

According to an embodiment, when the vehicle is in the raised position the distance of the means for accommodating at least one passenger from the water surface is greater than the distance of the means for accommodating at least one passenger from the water surface, when the vehicle is in the stop position.

Advantageously, according to a possible embodiment, except for the stop position, the vehicle is arranged outside the water, thus the water needed for operating the ride can be reduced. Additionally, the movement of the vehicle outside the water allows to increase its velocity compared with rides wherein the vehicles are moved on a water flow.

In addition, when the ride is arranged in the raised position the vehicle is outside the water and at a distance from the water surface, therefore the movement from the raised position to the stop position is not in contact with the water as in the known amusement ride wherein vehicles are moved in a water flow.

The ride further comprises lifting means to move said vehicle from the stop position to the raised position. Preferably, the vehicle is dropped from the raised position to "fall" into the stop position.

The vehicle moved from the raised position towards the stop position is decelerated by the contact with water stored in said container, so that the stop position (in which the vehicle is stopped) can be reached. Advantageously, according to an embodiment of the invention, the water is used to decelerate and thus to stop the vehicle.

The movement of the vehicle can be advantageously performed outside the water, until it contacts the water surface stored in the container. Preferably, the dimensions and design of the vehicle and of the water container that serves as stopping means are such as to avoid the vehicle being completely submerged by the water.

According to an embodiment of the invention, the guide means are arranged outside the water.

According to another embodiment of the invention, the vehicle is moved from the raised position to the stop position by the gravity force. An advantage of this embodiment is to increase the thrill and in the general the experience for the passenger by providing a fall movement of the vehicle from the raised position, at distance from the water surface, to the stop position.

Additionally, the contact with water generates water splashes allowing visual effects and, in some cases, also the contact of passengers with splashed water.

According to a preferred embodiment, in the stop position the vehicle floats on the water stored in the container.

According to an embodiment of the invention, the direction of the velocity vector of the vehicle for at least part of the movement from the raised position to the stop position, preferably at least in correspondence of the contact of the vehicle with the water, is inclined with respect to the water surface of an angle comprised in the range 90°-45°, preferably of an angle of 90°-60°, more preferably of an angle of 90°-75°, and most preferably of 90°.

These ranges of inclination allow to obtain a thrilling descent movement from the raised position to the stop position, while also allowing an effective deceleration of the vehicle due to the contact with the water.

According to a preferred embodiment, the vehicle is moved from the raised position to the stop position and/or from the stop position to the raised position along a straight line. The straight line along which the vehicle is movable is inclined with respect to the water surface of an angle comprised in the range 90°-45°, preferably of an angle of 90°-60°, more preferably of an angle of 90°-75°, and most preferably of 90°.

In other words, according to a possible embodiment, in the movement along the straight line the direction of the velocity vector corresponds, or it is parallel, to the straight line of movement of the vehicle.

Advantageously, the movement of the vehicle along a straight line with the claimed range of inclination, preferably arranged substantially perpendicular with respect to the water surface, results in increased thrill due to a descent at high velocity from the raised position to the stop position.

The movement of the vehicle from the stop position to the raised position can be performed along a straight line, as mentioned above. According to a possible embodiment the vehicle is moved from the raised position to the stop position and from the stop position to the raised position along a straight line.

According to an exemplary embodiment of the invention, the amusement ride comprises guide means allowing the movement of the vehicle from the stop position to the raised position and/or from the raised position to the stop position.

According to a possible embodiment, guide means for the movement of the vehicle from the stop position to the raised position are provided and then the vehicle is released from the guide means to move, preferably under gravity force, from the raised position to the stop position. According to an embodiment of the invention, guide means are provided to guide the movement of the vehicle from the stop position to the raised position and from the raised position to the stop position. The same guide means, or different guide means, can be used for the movement of the vehicle from the stop position to the raised position and from the raised position from the stop position.

According to an embodiment of the invention, the guide means comprises at least one rail, preferably a straight rail, along which the vehicle is movable. According to still another embodiment the ride comprise two guiding rails preferably arranged parallel one to another along which the vehicle is movable. According to an embodiment of the invention, the vehicle is movable back and forth between the raised position and said stop position, according to a reciprocating movement.

The movement back and forth allows to reduce the area needed for the installation of the amusement ride. In fact, the raised position is arranged substantially above the water surface, without the need of a closed path along which the vehicle is moved.

It has to be noted that the term movable back and forth is used to indicated that the at least one vehicle is not moved in a loop circuit in the same sense. On the contrary, the movement is carried out in one sense from the raised position to the stop position and the movement is inverted (in a sense opposite to the first sense) to return the vehicle from the stop position to the raised position. In other words, the vehicle can be moved with a reciprocating movement between the raised position and the stop position.

An advantage of the ride according to the present invention is to decelerate the vehicle using the water stored in the container. According to a possible embodiment the deceleration of the vehicle due to the contact with the water is within safe acceleration limits for amusement devices, according to safety code. According to possible embodiments, the deceleration of the vehicle due to the contact with the water is equal to, or below, 5 g, preferably 4 g.

According to still another embodiment of the invention, the vehicle comprises a contact body with the water having a leading portion, e.g. a portion firstly contacting the water during the movement between the raised position and the stop position, the contact body is tapered toward the leading portion. According to a possible embodiment the vehicle, and in particular the contact body, is provided with a tapered cross section, preferably in a plane perpendicular with respect to the water surface.

Advantageously, the tapered shape of the contact body allows to reduce the maximum accelerations deriving from the contact of the vehicle with the water surface.

Therefore, the tapered shape of the vehicle allows to reduce the peak g-values (accelerations) generated when the vehicle, moved from the raised position to the stop position, contacts the water stored in the container.

According to an embodiment of the invention, the container has at least a portion substantially complementary shaped to the vehicle, preferably substantially complementary shaped to the contact body of the vehicle. In the present description, complementary shaped means that the shapes are similar, but that the dimensions are such as to leave enough water between the vehicle and the walls of the container to have the required deceleration of the vehicle.

An advantage of this embodiment is to provide a container substantially shaped as the vehicle, and in particular its contact body, so that due to the contact of the vehicle with the water surface, the movement of the water inside the container is limited thus providing an effective deceleration in container having limited depth.

According to a further embodiment of the invention, the vehicle and/or the container are symmetrically shaped with respect to a plane, preferably said plane being perpendicular with respect to water surface. According to still an embodiment of the invention the straight line along which the vehicle is movable lies on said plane of symmetry, or on a plane parallel to said plane of symmetry.

According to still another embodiment of the invention, the rides comprises splashing means to eject water when the vehicle is moved in the stop position and contacts the water.

The splashing means can comprises at least one passage allowing the passage of water from said container towards the external environment (outside said container). The at least one passage can be provided in the opening of the water container defining the water surface between the area occupied by the vehicle in the stop position and the perimeter of the opening of the container.

According to an embodiment, at least one divider element is provided to define at least one passage for ejecting the water outside the container. The at least one divider element can be arranged in correspondence of the opening of the container defining the water surface, preferably between the area occupied by the vehicle in the stop position and the perimeter of the container.

The present invention also relates to a method of operating the amusement ride, as disclosed in claim 24 and relevant dependent claims.

According to an embodiment of the invention, the method comprises the step of loading at least one passenger on the vehicle, preferably when the vehicle is in the stop position, the step of moving the vehicle from the stop position to the raised position from the water surface. This step can be carried out by activating said lifting means of the ride.

The method further comprises the step of moving the vehicle from the raised position towards the stop position, during this step, the vehicle is decelerated by the contact with water to reach the stop position.

According to a possible embodiment, the step of moving the vehicle from the raised position to the stop position is carried out by the gravity force. In other words, the vehicle is subjected to a free fall (descent) from the raised position to the stop position, to increase fun and thrill of the passengers.

BRIEF DESCRIPTION OF THE DRAWINGS

Other features, advantages and details appear, by way of example only, in the following detailed description of embodiments, the detailed description referring to the drawings, in which.

DETAILED DESCRIPTION OF EXEMPLARY EMBODIMENTS OF THE PRESENT INVENTION

Figure 1:
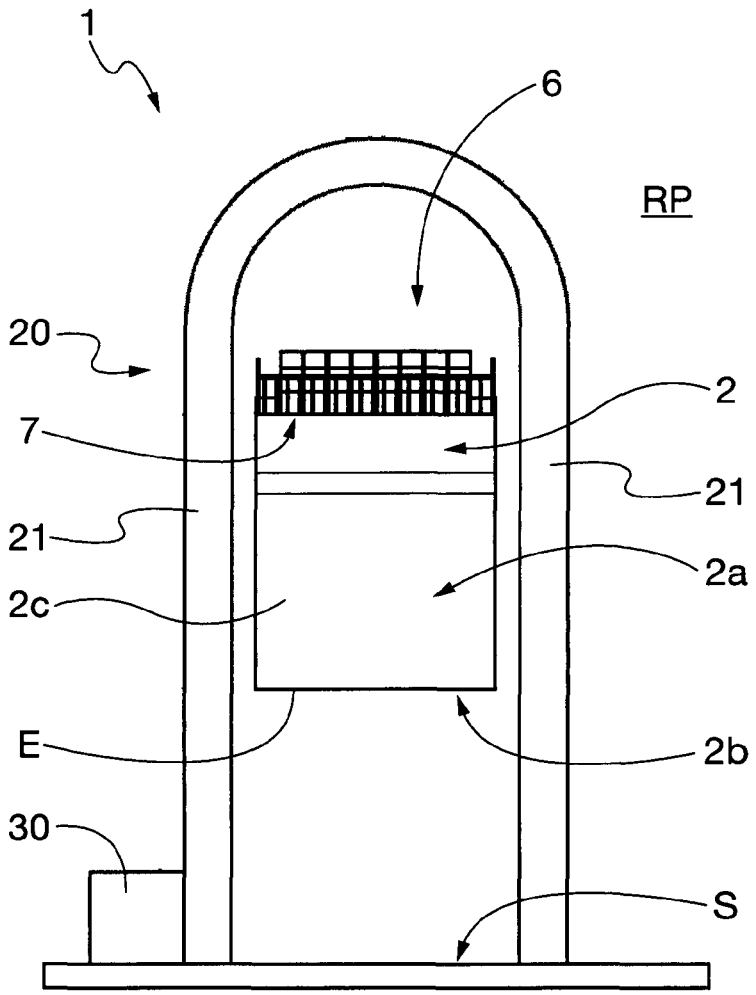
FIG. 1 is a frontal view of a possible embodiment of the ride according to the invention.

With reference to the attached FIGS. 1-4, the water amusement ride 1 according to the invention comprises one or more vehicles 2 having means 6 for accommodating one or more passenger(s), not shown in the figures.

In other words, the vehicle is provided with means 6 that are suitable for accommodating passengers and holding them in a condition of safety, such as for example one or more seat 6. The means 6 for accommodating one or more passenger(s) of the vehicle can comprise barriers and/or belts, shaped in such a way as to contain the at least one passenger who is being carried.

In other words, the vehicle 2 can provided with one or more seats 6, or any other suitable means to allow the passenger to be accommodated therein. According to a possible embodiment the passenger are accommodated in the vehicle in a standing position, preferably on a surface (platform) of the vehicle.

According to an exemplary embodiment, as shown in the non-limiting figures, the vehicle 2 comprises an upper surface 7 on which the passenger(s) can be received. A plurality of seats 6 are arranged on said surface 7, preferably in a plurality of rows. However, according to possible further embodiments, different arrangements of the seats 6 can be provided.

Figure 3:
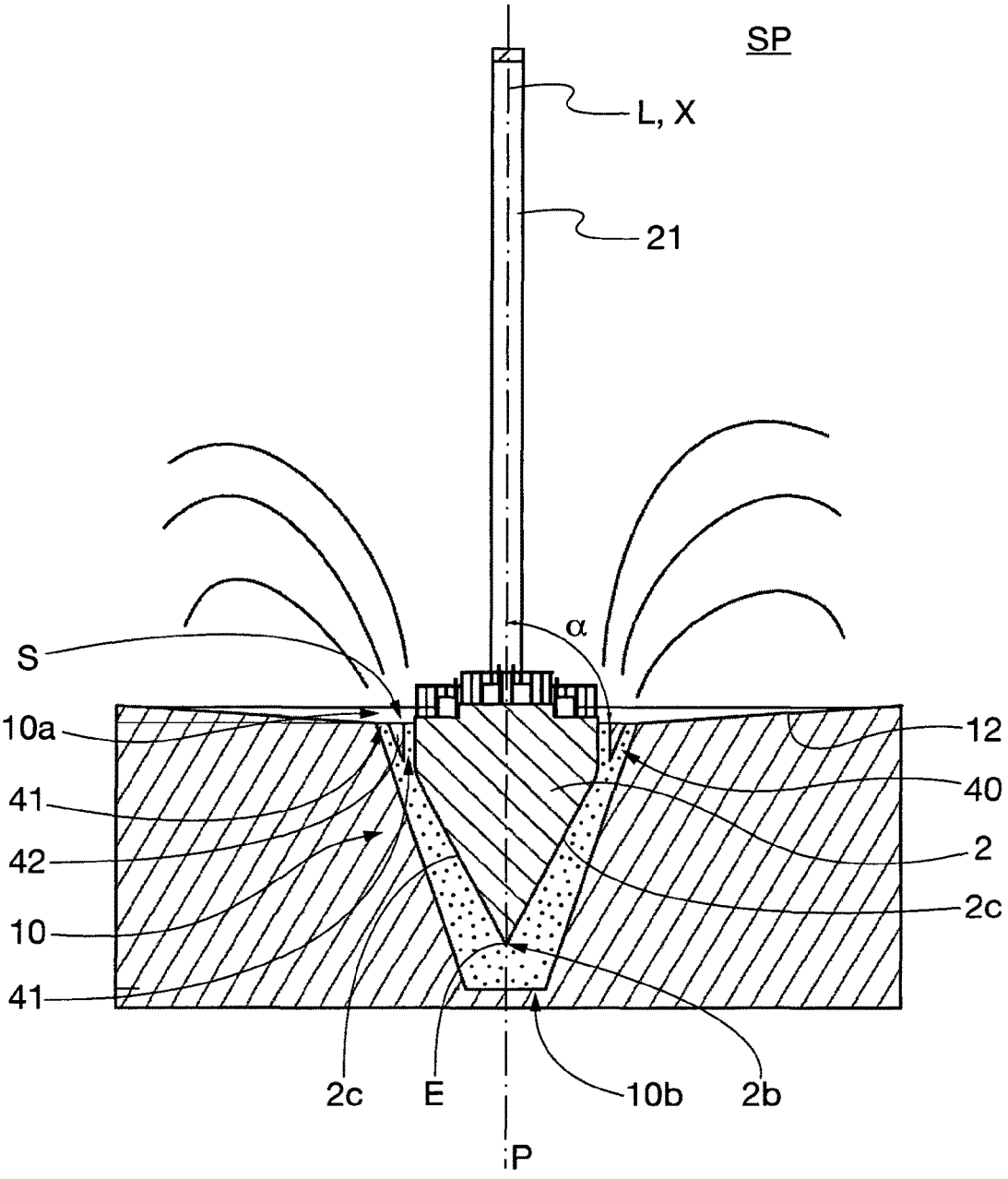
FIG. 3 is a partially sectioned side view of an embodiment of the ride according to the invention taken along the line A-A of FIG. 2.

The amusement ride 1 further comprises a water container, i.e. a water reservoir, 10 inside which water is stored, see for example FIG. 3.

The container 10 is provided with an opening 10*a* (i.e. a not closed surface, or a portion of a not closed surface), preferably a top opening, to define a water surface S. In other words, the water present in the container 10 forms a free surface S in correspondence of the opening 10*a* of the container. Water is schematically shown in FIG. 3 with dots inside the container 10.

It has to be noted that the water container 10 can be formed as an artificial pool. Preferably, the water container is completely, or at least in part, arranged in the ground; alternatively it can be supported on the ground, or on a suitable support surface.

The water container 2 can be arranged in the ground so as the water surface S substantially corresponds to the surface of ground around the container. According to a possible exemplary embodiment, as for example shown in the figures, the opening 10*a* can be arranged slightly below the surface of the ground around the container 10, so that the water splashed outside the container during the operation of the amusement ride can be collected inside the container by inclined surfaces 12 (as for example shown in FIG. 3).

Obviously, the water container 10 can be provided with a water supply and/or discharge lines (not shown), intended to control the water level inside the container.

The opening 10*a* of the container 10 allowing the formation of a water surface S can be provided with different shapes. For example, an opening 10 having a polygonal or a substantially circular shape (i.e. a polygonal or a substantially circular shape) can be provided. The term "polygonal" is used to indicate a shape formed by a chain of straight segments closing in a loop.

The term "substantially circular" is used to indicate a shape formed by a curved line, such as for example a circumference, an elliptic form, etc.

Also an opening 10*a* formed by a combination of a polygonal shape and a substantially circular shape, and in general by a combination of at least a portion comprising one or more segments and at least a portion comprising at least one curved line, can be provided.

According to a possible embodiment the shape of the opening 10*a* of the container 10 and the upper portion of the container 10, preferably in correspondence of the surface 7 where passengers are received, have substantially the same shape.

Figure 2:
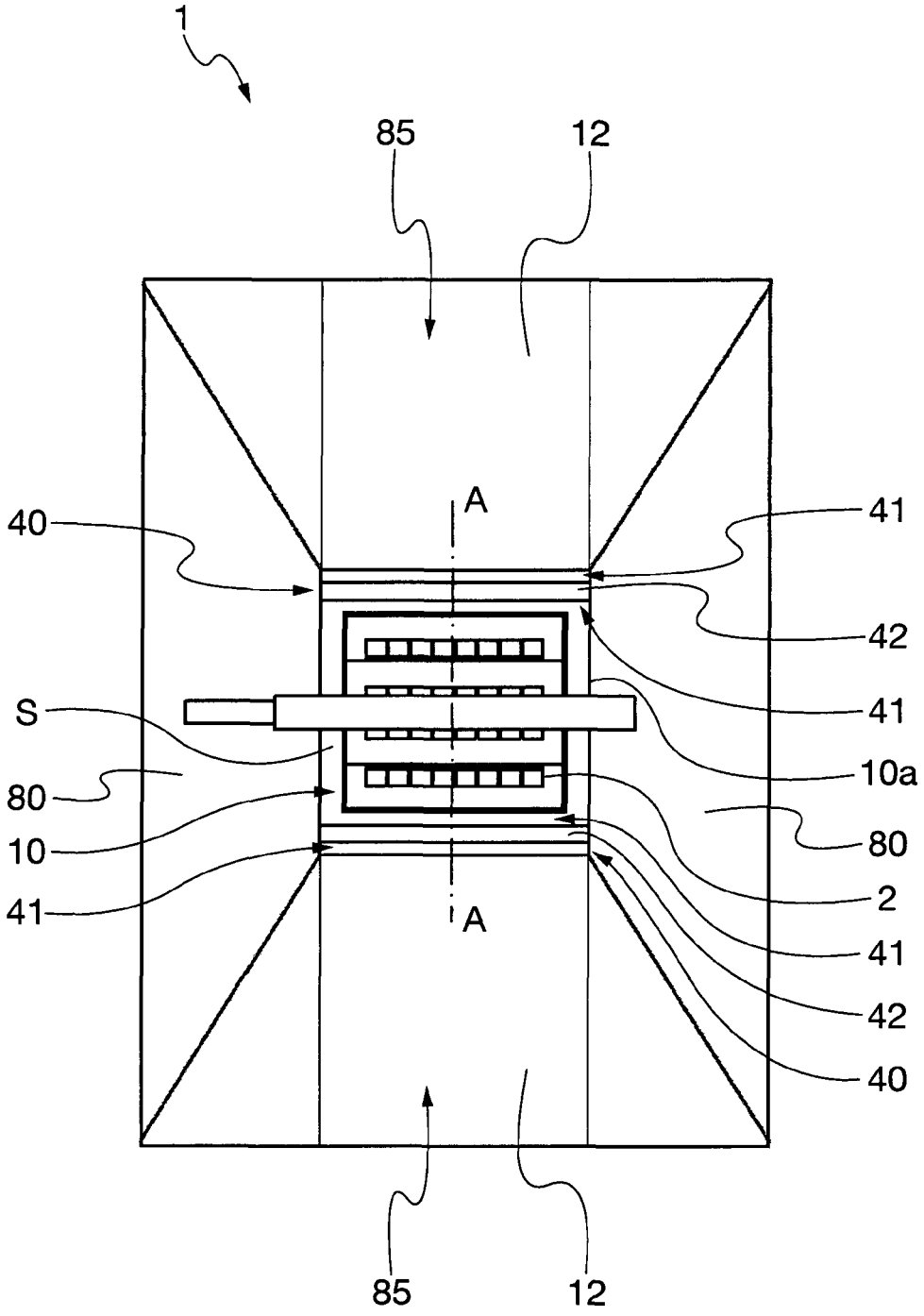
FIG. 2 is a plan view from above of an embodiment of the ride according to the invention shown in FIG. 1.

For example, in the shown embodiment the opening 10*a* of the container 10 has a rectangular shape and the upper portion of the vehicle 2 has a rectangular shape too, see for example the plan view of FIG. 2.

The vehicle 2 is moveable between a raised position RP, in which the vehicle is at a distance from the water surface S, and a stop position SP, in which part of the vehicle 2 is submerged in the water stored in the container 10. According to a possible embodiment, as for example shown in the figures, in the raised position RP the vehicle is outside the water and it is at a distance from the water surface S.

According to an embodiment, the distance of the means 6 for accommodating at least one passenger (e.g. at least one seat 6) from the water surface S, when the vehicle is in the raised position RP, is greater than the distance of the means 6 for accommodating at least one passenger (at least one seat 6) from the water surface S, when the vehicle 2 is in the stop position SP.

In general, the distance of the upper surface 7 of the vehicle 2 from the water surface S, when the vehicle is in the raised position RP, is greater than the distance of the upper surface 7 of the vehicle 2 from the water surface S, when the vehicle is in the stop position SP.

Figure 4:
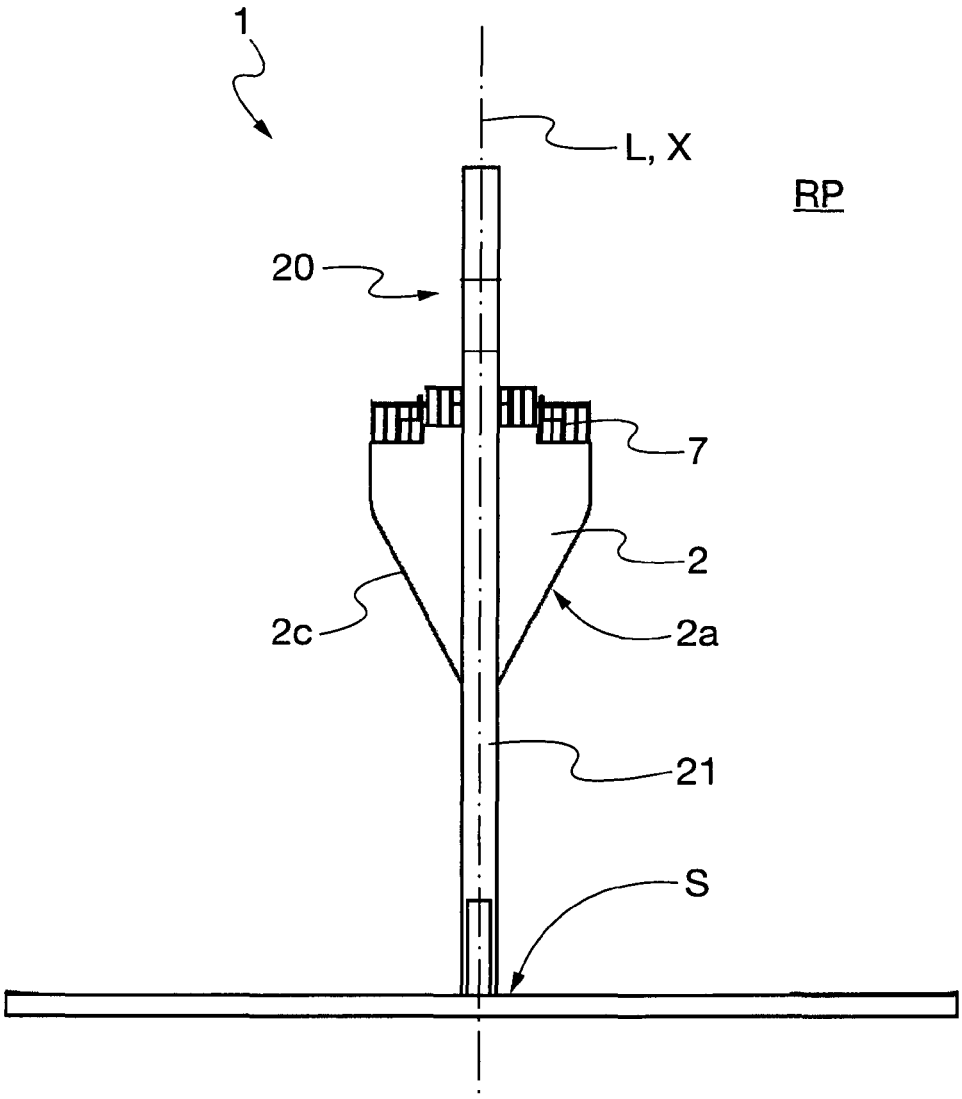
FIG. 4 is a lateral view of an embodiment of the ride according to the invention shone in FIG. 1.

The raised position RP is for example shown in FIGS. 1 and 4, while the stop position SP is shown in FIG. 3.

According to a possible embodiment, in the raised position RP the vehicle is arranged at a distance from the water surface S of 12 meters.

The vehicle 2 moved, preferably dropped, from the raised position RS towards the stop position SP is decelerated by the contact with water. In other words, in the movement from the raised position RP to the stop position SP, when the vehicle contacts the water, the vehicle is decelerated due to the contact with it and reaches the stop position SP wherein the vehicle does not move. In other words, the vehicle is decelerated and then it reaches the stop position in which it is stopped. According to a preferred embodiment, the vehicle in the stop position floats on the water surface S.

The amusement ride 1 further comprises lifting means 30 to move said vehicle from the stop position SP to the raised position RP.

According to a possible embodiment, the lifting means 30 comprise at least one motor, as for example schematically shown in FIG. 1. The at least one motor is connected by suitable connecting elements to the vehicle 2 in order to generate a lifting force on the vehicle so that it can be distanced from the stop position SP into the raised position RP.

The movement of the vehicle 2 from the raised position RP to the stop position SP is preferably carried out under the gravity force. In other words, according to a preferred embodiment of the invention, the vehicle 2 releases from the lifting mechanism and falls under gravity from the raised position towards the water surface S, and thus towards the stop position.

It has to be noted that according to a possible embodiment, the movement of the vehicle 2 from the raised position to the stop position is free and braking means are not used, in order to increase the passenger's experience. In particular, as already mentioned above, the vehicle is preferably moved outside the water and it is decelerated to reach the stop position by means of the contact with the water.

However, according to different possible embodiments, the movement of the vehicle from the raised position RP towards the stop position can be at least in part controlled. For example, the velocity of the movement of the vehicle from the raised position to the stop position can be set on predetermined value, or modified, or the movement can be slowed down, by suitable control means (e.g. braking means).

The lifting means 30 can be also used to control the movement of the vehicle from the raised position to the stop position.

According to an aspect of the invention, the direction of the velocity vector X of the vehicle 2 for at least part of the movement from the raised position RP and the stop position SP, preferably at least when the vehicle 2 contacts the water, is inclined with respect to the water surface S of an angle $\alpha$ comprised in the range 90°-45°, preferably of an angle comprised in the range 90°-60°, more preferably of an angle comprised in the range of 90°-75°, and most preferably of 90°.

In other words, the direction X of the velocity vector of the vehicle 2, is inclined with respect to the plane defined by the water surface S, for at least part of the movement from the raised position and the stop position, preferably in correspondence of the contact of the vehicle 2 with the water.

According to possible embodiments, the vehicle 2 is movable from the raised position RP to the stop position SP and/or from the stop position SP to the raised position RP along a straight line L.

According to a possible embodiment, as for example shown in the attached figures, the vehicle 2 is moved between said raised position RP and said stop position SP, i.e. in the lifting movement and in the descent movement, along a straight line L.

It has to be noted that the direction of movement X of the velocity vector of the vehicle corresponds to, or it is parallel to, the straight line L, as for example shown in the attached figures.

The straight line L along which the vehicle is movable is inclined with respect to the water surface S of an angle $\alpha$ comprised in the range 90°-45°, preferably of an angle of 90°-60°, more preferably of an angle of 90°-75°, and most preferably of 90°.

According to a preferred embodiment, as for example shown in the figures, the inclination angle $\alpha$ of the direction of the velocity vector X of the vehicle 2 (and/or of the straight line L of movement of the vehicle) with respect to the water surface S is 90°, i.e. the vehicle 2 is moved along a direction that is perpendicular with respect to the water surface S.

The amusement ride 1 further comprises guide means 20 to allow the movement of the vehicle 2 from the stop position SP to the raised position RP and/or from the raised position to the stop position. In the embodiment shown in the figures guide means are provided to guide the movement of the vehicle between the stop position SP and the raised position RP; the vehicle is guided in the lifting step (movement) and also during the descent step (movement), i.e. during the fall. However, according to possible embodiments, guide means can be provided to guide the movement of the vehicle from the stop position to the raised position or from the raised position to the stop position. According to a possible embodiment, guide means can be provided to guide the movement of the vehicle from the stop position to the raised position, and then the vehicle is released from the guide means 20 for at least part of the movement from the raised position to the stop position.

The guide means 20 comprise at least one rail 21, preferably a straight rail 21, along which the vehicle 2 is movable. The vehicle 2 is constrained in a movable manner to the rail 21 so that it can be moved along the rail 21.

According to a possible embodiment, the movement between the raised position and the stop position, in both senses, is obtained by a movement of the vehicle along the guide means 20, and in particular along the at least one rail 21.

The guide means 20, and for example the at least one guide 21, are arranged so that the vehicle 2 is moved with the direction X of the velocity vector (and/or the direction of the line L) that is inclined with respect to the water surface S of an angle $\alpha$ comprised in the range 90°-45°, preferably of an angle comprised in the range 90°-60°, more preferably of an angle comprised in the range of 90°-75°, and most preferably of substantially 90°.

In other words, the at least one rail 21 along which the vehicle is movable, is inclined with respect to the water surface S of the angle $\alpha$.

The at least one rail 21 is preferably vertical, or substantially vertical, i.e. inclined with respect to the water surface S of an angle of substantially 90°.

According to possible embodiment, as for example shown in the figures, the guide means 20 comprise two straight rails 21, arranged perpendicularly with respect to the water surface S, and thus with respect to the ground.

The two rails 21, forms two columns to which the vehicle is constrained in a movable manner, e.g. to be slidable along the rails 21.

The two guides 21 can be connected together in correspondence of their upper portions, as for example shown in the figures, in order to increase the structural strength. However, according to different possible embodiments, the two guides can be completely separated one with respect to another.

As already mentioned above, in the amusement ride according to the invention the deceleration of the vehicle 2 is carried out by the contact with the water. According to a possible embodiment, the maximum deceleration to which the vehicle is subjected, and thus to which also the passengers are subjected, is equal to, or below safe and comfortable rider acceleration levels; exemplary accelerations are equal to, or below, 5 g, preferably 4 g.

The vehicle 2 is shaped so as to reduce the impact forces and peak g-values exerted on the passengers due to the contact with the water during the deceleration of the vehicles. The vehicle 2 is also shaped to maintain within acceptable values the depth of the container 10 necessary to perform the deceleration of the vehicle without causing a contact of the vehicle with the bottom surface 10*b* (lower surface) of the container 10.

According to an embodiment, the vehicle 2 comprises a contact body 2*a* with the water having a leading portion 2*b*. The contact body 2*a* is substantially completely submerged in the water when the vehicle is in the stop position (as for example shown in FIG. 3).

It has to be noted that the leading portion 2*b* is substantially the first portion of the vehicle 2, and in particular of the contact body 2*a*, that is firstly contacting the water during the movement of the vehicle towards the stop position.

The contact body 2*a* is tapered (i.e. has a tapered shape) toward the leading portion 2*b*. It has to be noted that the term tapered is used herein to indicate a reduction of dimensions of the contact body toward the leading portion 2*b*.

More in detail, according to a possible embodiment, the contact body 2*a* is extending substantially from the upper surface 7 of the vehicle 2 on which the passengers are accommodated, towards the leading portion 2*b* with a tapered shape.

According to a possible embodiment, as for example shown in the figures, the contact body 2*a* has a constant dimension and does not taper for a portion 2*d* below the upper surface 7 of the vehicle.

According to a possible embodiment, the contact body 2*a* of the vehicle 2 has a tapered cross section toward said leading portion 2*b*. Preferably, the contact body 2*a* has a tapered cross section in a plane perpendicular to the water surface S.

It has to be noted that the contact body 2*a* can taper toward the leading portion 2*a* continuously, or discontinuously.

The contact body 2*a* comprises at least one lateral surface 2*c*. The lateral surface(s) 2*c* connects the upper portion of the contact body 2*a* with the leading edge 2*b*.

The lateral surfaces 2*c* can be flat surface, or curved, or a combination thereof. According to a possible embodiment the contact body 2*a* of the vehicle 2 is substantially V-shaped or U-shaped.

The leading portion 2*b* corresponds to the bottom portion of the substantially V-shape or of the substantially U-shape.

The leading portion 2*b* comprises at least one segment E, or at least one point, firstly contacting the water surface S during the movement of the vehicle 2 from the raised position RP toward the stop position SP.

Figure 5:
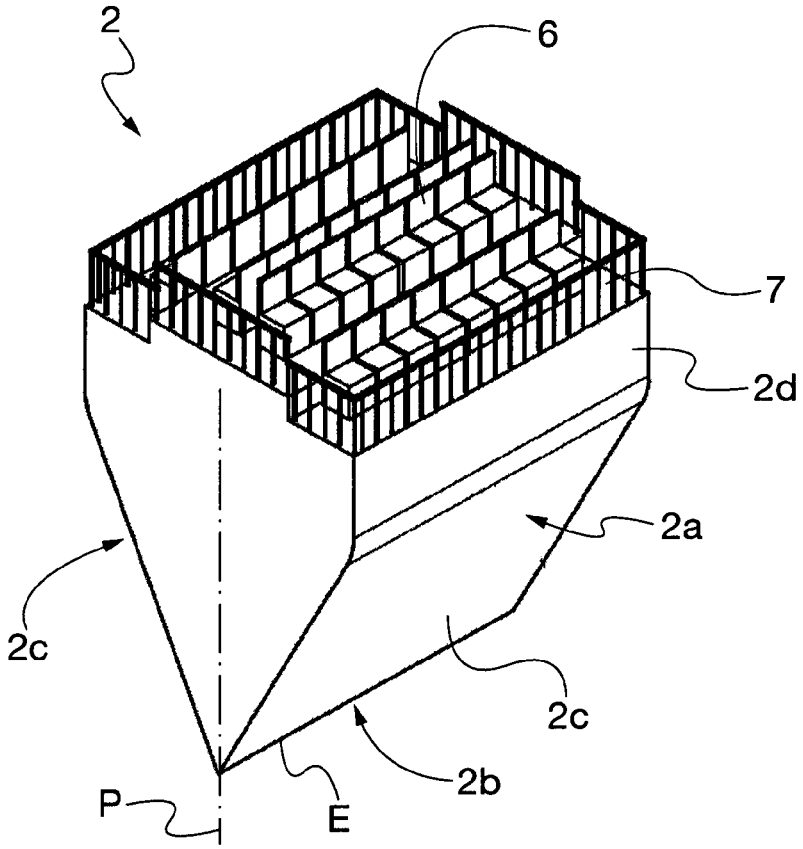
FIG. 5 is a perspective view a possible embodiment of a vehicle which can be used in the ride according to the invention.

In other words the contact body 2*a* tapers from an upper portion, i.e. a portion close or corresponding to the upper surface 7 of the vehicle where passengers are accommodated, towards the leading portion 2*b*. The leading portion can be provided in the form of a segment E, as for example shown in the figures, so that the contact body 2*a* is substantially wedge-shaped (for example two inclined lateral surfaces 2*c* can be provided, see for example FIG. 5).

According to a possible embodiment the leading portion 2*b* can comprise at least one point so that the contact body 2*a* has a substantially pyramid shape, or substantially conical shape, if the contact body has a circular upper portion.

It has to be also noted that according to further possible embodiments, the leading portion 2*b* can be provided in the form of an area (surface), having the same shape or a different shape of the upper portion of the contact body, and for example of the upper surface 7. The area forming the leading portion preferably is provided with reduced dimension with respect to the dimension of the upper portion of the contact body 2*a*, and for example of the upper surface 7.

According to this embodiment, the vehicle 2 and in particular its contact body 2*a* is provided with a tapered shape comprising a substantially truncated pyramid, or a substantially truncated cone.

The container 10 has at least a portion substantially complementary shaped to the vehicle 2, preferably substantially complementary shaped to the contact body 2*a* of the vehicle 2.

An advantage of this embodiment is to increase the efficiency in the deceleration of the vehicle, by allowing also to reach the stop position in a reduced depth of the container, and at the same time to reduce the g-values exerted on the vehicle 2 and thus on the passengers.

According to a possible embodiment, the water container 10 is tapered in the extension from the opening 10*a* defining the water surface S to the bottom surface 10*b*, i.e. the lower surface, of the container.

For example, as shown in the figures and in particular in FIG. 3, the vehicle 2 and in particular its contact body 2*a* is substantially V-shaped and the also the container 10 is substantially V-shaped.

The substantially complementary shape between the vehicle, and in particular its contact body 2*a*, and the container 10, also allow to eject part of the water contained therein to form water splashes, when the vehicle contacts the water to reach the stop position (as for example schematically shown in FIG. 3).

According to a possible embodiment, the vehicle 2 and/or the container 10 are symmetrically shaped with respect to a plane P. According to a possible embodiment, the plane P is perpendicular with respect to the water surface S. According to a possible embodiment, the plane P substantially passes through, or it is parallel, to the direction X of the velocity vector (and/or the straight line L of movement) of the vehicle 2.

According to a possible embodiment the plane P is passing through the leading portion 2*b* of the contact body 2*a*, and in particular through the segment E.

It has to be noted that in a planar view the plane P of symmetry correspond to an axis of symmetry.

According to a possible embodiment, the ride 1 comprises splashing means 40 to eject water when the vehicle 2 is moved in the stop position SP.

The splashing means 40 comprises at least one passage 41 of the opening 10*a* of the water container 10. Preferably, the passage is arranged between the area occupied by the vehicle 2 in the stop position SP and the perimeter of the container 10 (and in particular the perimeter of the opening 10*a*).

When the vehicle 2, moved from the raised position RP reaches the contact with the water and it is decelerated, the water in the container 10 is in part ejected outside the container, thorough at least one passage 41.

The at least one passage 41 for the water can be formed by at least one divider elements 42, for example arranged in correspondence of the opening 10*a*.

According to a possible embodiment, the at least one divider element 42 is arranged in the opening 10*a* of the water container 10 between the area occupied by the vehicle 2 in the stop position SP and the perimeter of the container 10.

In the embodiment shown in the figures, two linear divider elements 42 are provided to form four parallel passages 41 for the water.

It has to be noted that the at least one passage 41 of the ride allow to form at least one funnel intended to eject water outside the container in a controlled manner.

In fact, the passages 41 can be arranged and shaped so as to form water splashing having desired height, inclinations, etc. According to an aspect of the invention, the divider elements 42 can be shaped so as to modify the shape of the passage 41.

According to a possible embodiments, the at least one passage 41 for the water ejection is provided with a tapered section with respect to the direction of movement of the water towards outside the container.

The divider elements 42 can be provided with a substantially tapered sections, and in particular with a substantially V-shape.

According to possible embodiments, the water splash, or at least part of the generated water splash can be obtained by a water ejecting device.

The ride 1 according to the invention also comprises at least one collecting area 85 for splashed water outside the container 10 when the vehicle 2 is moved in the stop position SP. The collecting area 85 can be provided for example in the form of an inclined surface 12 to collect water ejected outside the container and to redirect it inside the container.

Other embodiments can be provided, for example by arranging a draining surface, or a grid, in correspondence of the collecting area, preferably fluidically connected to the container 10, for example by means of a duct, to redirect the water inside the container.

In order to allow the loading/unloading of passenger(s) on/from the vehicle 2, the vehicle 2 is provided with at least one loading and/or unloading area 80, preferably arranged around the water container 10.

The same area can be used to load/unload passengers, however in order to speed up these operations, a dedicated area for loading passenger and a dedicated area for unloading passengers can be provided. As for example shown in the figures (see in particular the plan view of FIG. 2) two areas 80, one for the loading operations and one for the unloading operations, are provided substantially in correspondence of two opposite sides of the vehicle 2, and thus of the container 10.

The method of operating an amusement ride according to the invention will be now disclosed. It has to be noted that aspects and features of the ride 1 disclosed above can be applied also to the method of operating the ride, and vice versa.

The method of operating the ride comprises the step of loading at least one passenger on the vehicle 2 when the latter is in the stop position SP. As mentioned above, in the stop position the vehicle in the stop position floats on the water in the container 10, with the upper surface 7 where the seats 6 for the passengers arranged above the water surface S.

The method further comprises the step of moving the vehicle 2 from the stop position SP to the raised position RP. This step is preferably performed by activating the lifting means 30, and in particular the at least one motor, to allow the movement of the vehicle in correspondence of the guide means 20.

As for example shown in the figures, the vehicle is moved along the rails 21 along which the vehicle can slide.

When the vehicle 2 reaches the raised position RP at distance from the water surface S, it can be maintained in this position for a predetermined amount of time or immediately moved toward the stop position SP.

The method comprises the step of moving the vehicle 2 from the raised position RP towards the stop position SP and the vehicle is decelerated by the contact with water to reach the stop position SP. As mentioned above, in connection to the ride 1, the vehicle is shaped to allow an efficient deceleration of the vehicle so as to limit the depth of the container and also by limiting the acceleration exerted on the passengers.

When the vehicle has reached the stop position, the passengers can be unloaded from the vehicle, or at least one another descent from the raised position can be provided by moving the vehicle from the stop position to the raised position.

In other words, the method further comprises the step of unloading at least one passenger from the vehicle 2, or the step of repeat at least one time the step of moving the vehicle 2 from the stop position SP towards the raised position RP and then the step of moving the vehicle from the raised position to the stop position.

According to a possible embodiment, as already mentioned above, the step of moving the vehicle 2 from the raised position RP towards the stop position SP is carried out by the gravity force. By doing so, the passengers experience high thrill and fun, in fact they are subjected to a free descent from the raised position towards the stop position.

The method further comprises the step of generating a water splash (water ejection) from the container 10 when the vehicle contacts the water surfaces S and it is decelerated to reach the stop position SP. As discussed above in connection to the ride 1, the water splash, i.e. an ejection of water outside the container, is automatically generated due to the contact of the vehicle with the water.

The invention claimed is:

1. A water amusement ride comprising at least one vehicle, said water amusement ride comprising an open-air apparatus for accommodating at least one passenger, a container for storing water having an opening to define a water surface, said vehicle being movable between a raised position with respect to the water surface, and a stop position being lower than the raised position, in which only part of the vehicle is submerged in the water, and lifting means for moving said vehicle from the stop position to the raised position, wherein the vehicle moved from the raised position towards said stop position is decelerated by contact with water in said container to reach said stop position.

2. The water amusement ride according to claim 1, wherein, in said raised position the vehicle is outside the water at a distance from the water surface.

3. The water amusement ride according to claim 1, wherein said apparatus for accommodating at least one passenger includes a seat.

4. The water amusement ride according to claim 1, wherein a direction of a velocity vector of the vehicle for at least part of the movement from the raised position to the stop position, is inclined with respect to the water surface at an angle in the range of about 90°-60°.

5. The water amusement ride according to claim 1, wherein said vehicle is movable from said raised position to said stop position and/or from the stop position to the raised position along a straight line.

6. The water amusement ride according to claim 1, wherein a direction of a velocity vector of the vehicle for the movement from the raised position to the stop position is inclined with respect to the water surface at an angle of about 90°.

7. The water amusement ride according to claim 1, wherein said vehicle is movable back and forth between said raised position and said stop position, said raised position being directly above said stop position.

8. The water amusement ride according to claim 1, wherein the deceleration of the vehicle due to the contact with the water is equal to, or below 4 g.

9. The water amusement ride according to claim 1, wherein the vehicle is moved from the raised position to the stop position by gravity.

10. The water amusement ride according to claim 1, wherein, in said stop position, said vehicle floats on the water in the container.

11. The water amusement ride according to claim 1, wherein said vehicle comprises a contact body and a leading portion, said contact body being tapered downwardly toward said leading portion.

12. The water amusement ride according to claim 11, wherein said leading portion comprises at least one segment firstly contacting the water surface when said vehicle is moved from the raised position toward the stop position.

13. The water amusement ride according to claim 12, wherein said contact body of said vehicle has a tapered cross section toward said leading portion in a plane perpendicular to the water surface.

14. The water amusement ride according to claim 11, wherein the contact body of the vehicle is substantially V-shaped or U-shaped.

15. The water amusement ride according to claim 1, wherein said water container is tapered from the opening defining the water surface to a bottom surface of the container.

16. The water amusement ride according to claim 15, wherein said water container has at least a portion shaped substantially similar to a shape of said contact body of the vehicle.

17. The water amusement ride according to claim 1, further comprising a guide for guiding movement of the vehicle from the stop position to the raised position and/or from the raised position to the stop position.

18. The water amusement ride according to claim 17, wherein said guide is located outside the water.

19. The water amusement ride according to claim 17, wherein said guide comprises at least one rail along which the vehicle is movable.

20. The water amusement ride according to claim 1, wherein the container is symmetrically shaped with respect to a plane substantially corresponding to a straight line along which the vehicle is movable.

21. The water amusement ride according to claim 1, further comprising at least one collecting area for splashed water outside the container.

22. The water amusement ride according to claim 1, further comprising at least one splashing device to eject water when said vehicle is moved to the stop position, said splashing device comprising at least one passage of the opening of the container, between an area occupied by said vehicle in the stop position and a perimeter of the opening of the container.

23. The water amusement ride according to claim 22, wherein said at least one passage is formed by one or more divider elements.

24. A method of operating an amusement ride according to claim 1, the method comprising:

loading at least one passenger on said vehicle when said vehicle is in the stop position;

moving the vehicle from the stop position to the raised position with respect to the water surface by said lifting means for moving; and moving said vehicle from the raised position towards the stop position, wherein said vehicle is decelerated by the contact with water to reach said stop position.

25. The method according to claim 24, further comprising unloading said at least one passenger from the vehicle or repeating said moving the vehicle from the stop position to the raised position.

26. The method according to claim 24, wherein said moving said vehicle from the raised position towards the stop position is carried out by gravity.

27. The method according to claim 24, wherein a water splash is generated from the water container when the vehicle contacts the water surfaces and is decelerated to reach the stop position due to the contact with the water.

28. The method of claim 27, wherein part of the generated water splash is obtained by a water ejecting device.

29. The method of claim 27, wherein said moving the vehicle from the stop position to the raised position comprises vertically moving, wherein said raised position is directly above said stop position.

30. A water amusement ride comprising at least one vehicle, said water amusement ride comprising an apparatus for accommodating at least one passenger, a container for storing water having an opening to define a water surface, said vehicle being movable between a raised position with respect to the water surface, and a stop position, in which at least part of the vehicle is submerged in the water, and lifting means for moving said vehicle from the stop position to the raised position, wherein the vehicle moved from the raised position towards said stop position is decelerated by contact with water in said container to reach said stop position, and further comprising at least one splashing device to eject water when said vehicle is moved to the stop position, said splashing device comprising at least one passage of the opening of the container, between an area occupied by said vehicle in the stop position and a perimeter of the opening of the container, said at least one passage formed by one or more divider elements.

31. A water amusement ride comprising at least one vehicle, said water amusement ride comprising an apparatus for accommodating at least one passenger, a container for storing water having an opening to define a water surface, said vehicle being movable between a raised position with respect to the water surface, and a stop position, in which at least part of the vehicle is submerged in the water, and lifting means for moving said vehicle from the stop position to the raised position, wherein the vehicle moved from the raised position towards said stop position is decelerated by contact with water in said container to reach said stop position, further comprising at least one loading area of at least one passenger on said vehicle when said vehicle is in said stop position.

* * * * *